United States Patent [19]

Hamada

[11] Patent Number: 4,630,370

[45] Date of Patent: Dec. 23, 1986

[54] OUTER CUTTER ASSEMBLY FOR AN ELECTRIC SHAVER

[75] Inventor: Toshikazu Hamada, Hikone, Japan

[73] Assignee: Matsushita Electric Works, Ltd., Japan

[21] Appl. No.: 746,836

[22] Filed: Jun. 20, 1985

[30] Foreign Application Priority Data

Jun. 20, 1984 [JP] Japan ..... 59-126819

[51] Int. Cl.[4] ..... B26B 19/14

[52] U.S. Cl. ..... 30/346.51; 76/101 A

[58] Field of Search ..... 30/43.6, 346.51; 76/101 A, 101 SM, DIG. 8, DIG. 6

[56] References Cited

U.S. PATENT DOCUMENTS 2,373,370 4/1945 Bahr ..... 30/346.51

FOREIGN PATENT DOCUMENTS 1034511 12/1958 Fed. Rep. of Germany .

58-157461 10/1983 Japan .

*Primary Examiner*—Jimmy C. Peters

*Attorney, Agent, or Firm*—Stevens, Davis, Miller & Mosher

[57] ABSTRACT

An outer cutter assembly for an electric shaver comprises an outer shearing foil, a base frame on which the outer shearing foil is mounted with its peripheral edge supported thereby. The outer shearing foil is formed with a plurality of hair entrance peripheral perforations arranged along the periphery thereof to be in hair shearing relation with an inner blade. A comb forming member is located between the peripheral edge of the outer shearing foil and the upper end of the base frame to have its lower portion connected to the base frame. The comb forming member is provided at its upper portion with a comb having teeth defining between the adjacent ones thereof slits each being in open communication with each of the peripheral perforations and being located inside thereof to be in alignment with each of a plurality of webs which separates the peripheral perforations from one another. Each tooth of the comb is kept in intimate contacting relation with each of the webs to thereby prevent the occurrence of any gap between the teeth of the comb and the adjacent webs in the peripheral portion of the outer shearing foil. Accordingly, the outer cutter assembly can assure intimate contacting relation between the comb and the outer shearing foil to eliminate the presence of an undesirable gap therebetween, giving rise to an efficient shaving operation without irritatingly pulling hairs of the user.

5 Claims, 22 Drawing Figures

OUTER CUTTER ASSEMBLY FOR AN ELECTRIC SHAVER

BACKGROUND OF THE INVENTION

1. Field of the Invention

The present invention is directed to an outer cutter assembly for an electric shaver, and more particularly to an arrangement of a comb formed interiorly along the perforated peripheral portion of an outer shearing foil of the cutter assembly for reinforcing that perforated portion.

2. Description of the Prior Art

Such comb is known to be included in an outer cutter assembly for reinforcing a perforated peripheral portion, more precisely webs which separate the adjacent ones of a series of hair entrance slots formed along the periphery of an outer shearing foil for feeding long or fuzzy hairs into shearing relationship with a cooperative inner cutter. A typical prior outer cutter assembly including the comb is disclosed in Japanese early publication (KOKAI) No. 58-157461 of a Utility Model application, in which the comb is integrally formed with a plastic base frame on which the outer shearing foil is mounted by pressing. However, the provision of the comb integral with the base frame may frequently lead an undesirable formation of a gap between the comb and the outer shearing foil, the result of which poses a problem in that hairs are sometimes caught in the gap causing them to be pulled during the shaving operation to thereby irritate the skin of the user. In addition to that clipped hair ends gradually accumulated and consolidated in the gap will act as a wedge to deform the curved surface of the outer shearing foil to such an extent as to lower shearing efficiency.

Such a gap is indispensable in the above structure from the fact that there normally exists variance in the sizes of the outer shearing foil and the comb integral with the base frame and that an attempt to eliminate the gap by providing the comb of a slightly greater size to compensate for that variance will certainly result in an excess pressure required to be applied to the outer shearing foil at the time of assembling the outer shearing foil on the base frame to thereby disadvantageously deform the outer shearing foil to an extent that efficient shearing is no longer to be expected.

SUMMARY OF THE INVENTION

The present invention has been accomplished in view of the above problems and provides a useful structure for eliminating the presence of any gap between an outer shearing foil and a comb disposed interiorly along the perforated peripheral portion thereof. An outer cutter assembly in accordance with the present invention comprises the outer shearing foil, a base frame on which the outer shearing foil is mounted with its peripheral edge supported thereby. The outer shearing foil is formed with a plurality of hair entrance peripheral perforations to be in hair shearing relation with an inner blade sliding against the inner surface of the outer shearing foil. Included in the outer cutter assembly is a comb forming member which is located between the peripheral edge of the outer shearing foil and the upper end of the base frame to have its lower portion connected to the base frame. The comb forming member is provided at its upper portion with a comb having teeth defining between the adjacent ones thereof slits each being in open communication with each of the peripheral perforations and being located inside thereof to be in alignment with each of webs which separate the peripheral perforations from one another. Adjoining means is provided for bringing each of the teeth in intimate contacting relation with each of the webs to thereby prevent the occurrence of any gap between the the teeth of the comb and the adjacent webs in the peripheral portion of the outer shearing foil.

Accordingly, it is a primary object of the present invention to provide an outer cutter assembly for an electric shaver which is capable of assuring intimate contact relation between the comb and the outer shearing foil to eliminate the presence of the gap therebetween, giving rise to an efficient shaving operation without irritatingly pulling the hairs.

In a preferred embodiment, the base frame is formed at its upper end with a projection which defines said adjoining means projecting into said comb forming member to separate the comb from the lower portion of the comb forming member in such a way that the upper portion undergoes shrinkage in its solidification process substantially independently of the shrinkage seen in the lower portion of the comb forming member. Thus, the upper portion or the comb is subjected to less amount of shrinkage as compared to the case where the whole comb forming member undergoes shrinkage without being restricted, thus preventing the presence of a gap and assuring intimate contact relation between the teeth of the comb and the webs of the outer shearing foil.

It is therefore another object of the present invention to provide an outer cutter assembly in which the comb will incur shrinkage in a minimum amount for effectively preventing the presence of a gap between the outer shearing foil and the comb.

Also disclosed in the present invention is an alternative structure for eliminating the presence of the gap. A rib formed at the upper end of the base frame projects into the comb at a position inwardly thereof in such a way as to prevent the inward displacement of the comb during its solidification, keeping the comb in intimate contacting relation with the outer shearing foil, which is a further object of the present invention.

In one embodiment of the present invention, the comb itself defines said adjoining means which is capable of adhereing the teeth of the comb respectively to the webs of the outer shearing foil by being heated for intimate contact therebetween. This heating treatment is done with the use of a suitable jig after positioning the comb in proper relation with the outer shearing foil and can well eliminate the presence of a gap between the comb and the outer shearing foil.

It is therefore a further object of the present invention to provide an outer cutter assembly in which the comb can be brought into intimate contacting relation with the outer shearing foil by being heated.

In further embodiments, the comb has at least a portion made of elastic material which is pressed against the inner surface of the outer shearing foil to assure intimate contacting relation therebetween. For this purpose, the whole comb forming member defining at its upper portion said comb may be made of elastic material, or the comb made of elastic material may be molded integrally with a rigid part at the lower portion of the comb forming member.

It is therefore a still further object of the present invention to provide an outer cutter assembly which assures intimate contacting relation between the comb and the outer shearing foil by the use of elastic material forming at least a portion of the comb.

The teeth of the comb in one embodiment of the present invention are provided along the edges on each side thereof with an ear which extends outwardly of the adjacent peripheral perforation in the outer shearing foil in such a way as to intimately cover the edge of that perforation at the portion which is not in shearing contact with the inner blade. With this result, the teeth of the comb can be retained by the edges of the perforations in a more secure manner to thereby improve the intimate contacting relation between the comb and the outer shearing foil, in addition to that the edges of the perforations which do not come into shearing relation with the inner blade can be protected by the ear or extension of the plastic comb so as not to irritate the skin of the user nor to pull a hair during the shaving operation, which is therefore another object of the present invention.

These and other advantageous features will become more apparent from the following description of the preferred embodiments of the present invention when taking in conjunction with the accompanying drawings.

DESCRIPTION OF PREFERRED EMBODIMENTS

Figure 1:
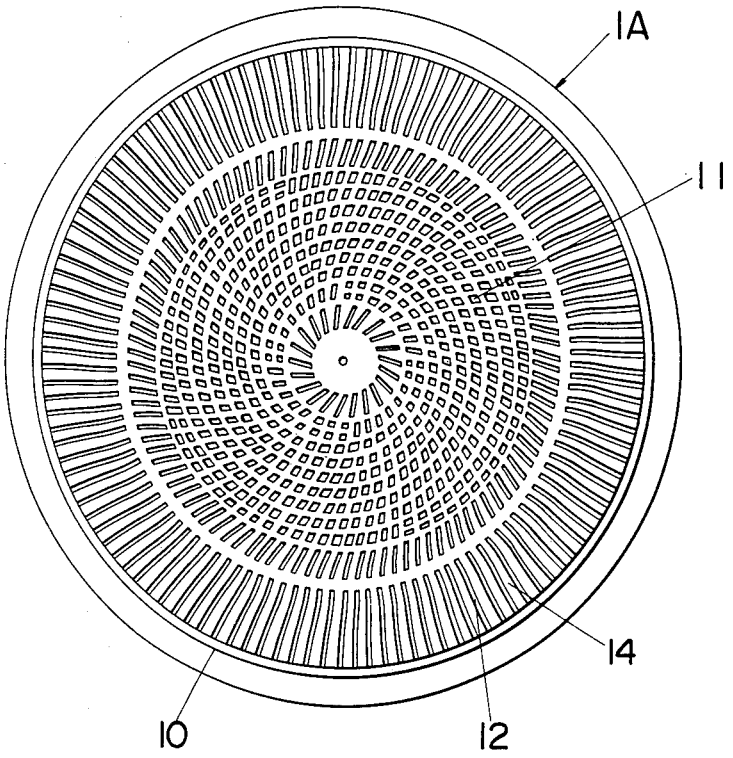
FIG. 1 is a top view of an outer cutter assembly in accordance with a first embodiment of the present invention.
Figure 2:
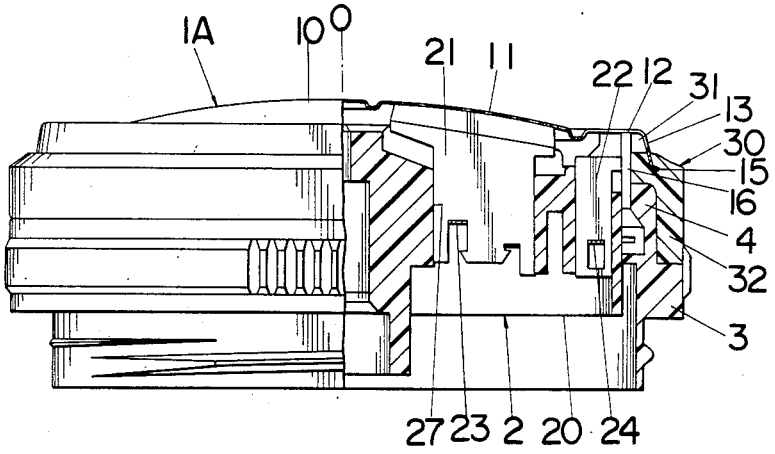
FIG. 2 is a front view, partly in cross section, of the above outer cutter assembly and an inner cutter assembly cooperative therewith.
Figure 3:
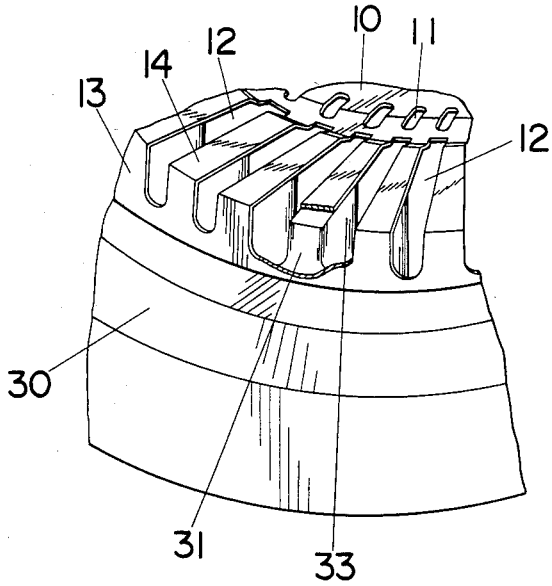
FIG. 3 is a partial view in perspective representation of the peripheral portion of the above outer cutter assembly.

Referring now to FIGS. 1 to 5, there is shown an outer cutter assembly for an electric shaver of rotary type in accordance with a first embodiment of the present invention. The outer cutter assembly 1A cooperates with an inner cutter assembly 2 to construct a cutting head and comprises a spherically curved circular outer shearing foil 10 which is supported at its peripheral edge on a base frame 3 made of plastic material with a comb forming member 30 interposed therebetween. The outer shearing foil 10 is made of a thin metal plate and formed in its center portion with a first group of plural hair entrance holes 11 arranged about an center axis O and formed in its peripheral portion with a second group of plural hair entrance slots 12 lying on a circle about the center axis O. Each of the hair entrance slots 12 is oriented in a generally radial direction to extend into an outer sidewall 13 depending from the periphery of the outer shearing foil 10, as best shown in FIG. 3, so as to define thereat a generally vertical opening through which long or fuzzy hairs can be easily fed into the slot 12 for an efficient shearing purpose. The slots 12 are evenly spaced circumferentially and separated from one another by webs 14. Said inner cutter assembly 2 comprises an assembly base 20 mounting thereon first and second inner blades 21 and 22 which are biased upwardly by first and second spring leaves 23 and 24 into hair shearing engagement respectively with said holes 11 and slots 12.

Included in the outer cutter assembly 1 is the comb forming member 30 shaped by plastic material into a ring interposed between the base frame 3 and the outer shearing foil 10. The comb forming member 30 is located radially outwardly of the path in which the second inner blades 22 moves so as to leave therebetween a clearance 16 and has its lower portion surrounding the upper end of the base frame 3. Provided at the upper portion inwardly of the depending sidewall 13 is a comb 31 in the form of a ring having teeth defining therebetween slits 33 which are in open communication respectively with said slots 12 in the peripheral portion of the outer shearing foil 10. It is the teeth of the comb 31 that back against said webs 14 in exact alignment therewith for reinforcing the perforated peripheral portion of the the outer shearing foil 10.

Figure 4:
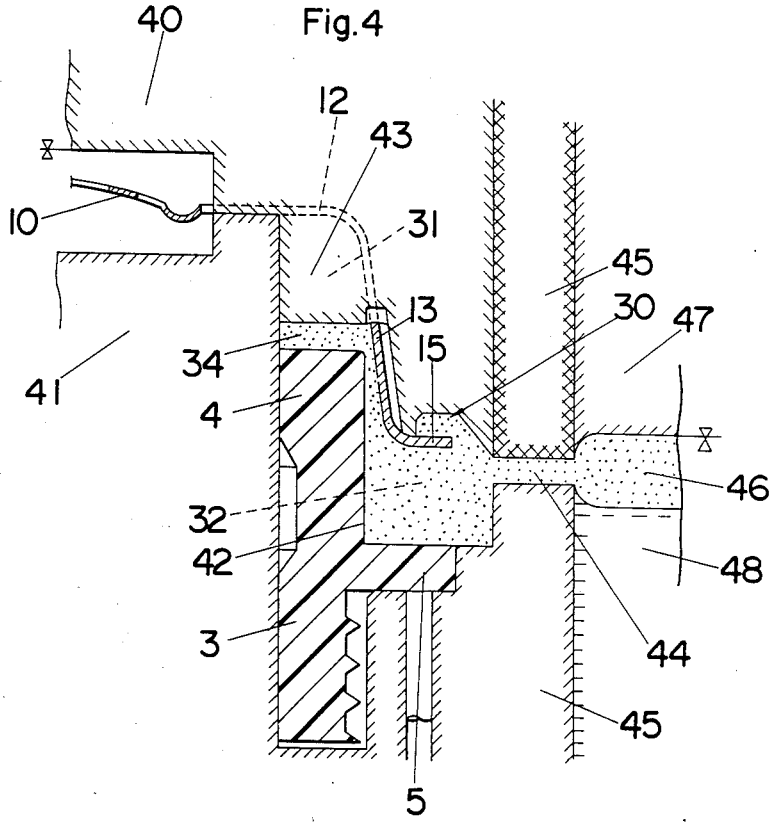
FIG. 4 is an explanatory view in somewhat exaggerated representation of the molding operation of incorporating a comb forming member into the outer cutter assembly.
Figure 5:
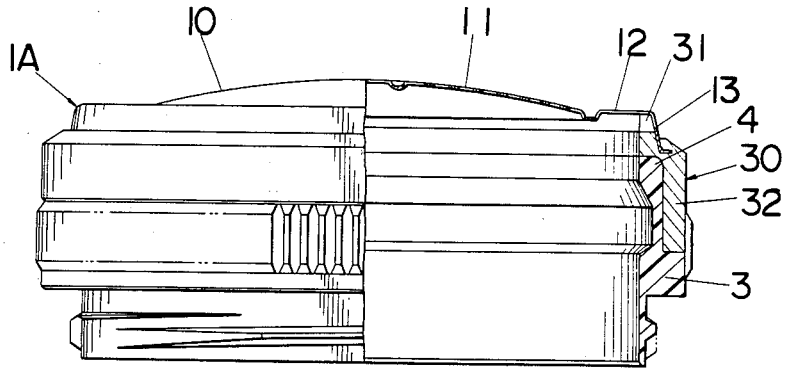
FIG. 5 is a front view, partly in cross section, of the above cutter assembly with the inner cutter assembly removed therefrom.

Said comb forming member 30 is molded integrally with the base frame 3 and the outer shearing foil 10 by an injection molding as shown in FIG. 4. The base frame 3 and the outer shearing foil 10 are retained in position between an upper mold 40 and a lower mold 41 in such a manner as to form therebetween a cavity 42 into which plastic material is to be fed for integral molding of the comb forming member 30. The upper mold 40 is provided with a toothed section 43 which projects through the slots 12 into the inside of the outer shearing foil 10 so as to form said teeth of the comb 31 inside of the outer shearing foil 10. The base frame 3 is formed at its upper end with a projection 4 which projects into the cavity 42 for separating the comb forming member 30 to be formed therein into the upper portion or comb 31 and the lower portion 32 while leaving between the bottom of the toothed section 43 and the projection 4 a limited space for forming a bottom wall 34 of the comb 31 connecting the upper and lower portions of the comb forming member 30. The lower portion 32 of the comb forming member 30 is formed around said projection 4 of the base frame 3 to extend downwardly from the bottom wall of the comb 31 to a point where it joins a nub 5 on the side of the base frame 3. The lower end portion of the depending sidewall 13 and a flange 15 at the lower extremity thereof are inserted into the lower portion 32 of the comb forming member 30 for integral connection of the outer shearing foil 10 with the base frame 3 through the comb forming member 30. With this arrangement of the comb 31 being separated from the lower portion of the comb forming member 30 by the projection 4 at the upper end of the base frame 30, the comb 31 undergoes shrinkage during its solidification substantially independently from that of the lower portion 32 and therefore is subjected to less amount of shrinkage than a case wherein the whole comb forming member 30 undergoes shrinkage without being restricted by the projection 4 of the base frame 3. Consequently, the teeth of the comb 31 can be kept in intimate contacting relation respectively with the webs 14 of the outer shearing foil 10 to thereby prevent the presence of any gap therebetween, eliminating the trapping of hairs in the gaps during the shaving operation to assure a comfortable and efficient shaving. After molding, the comb forming member 30 is cut off at a gate 44 by a pair of knives 45 from a runner 46 defined between upper and lower plates 47 and 48.

Figure 6:
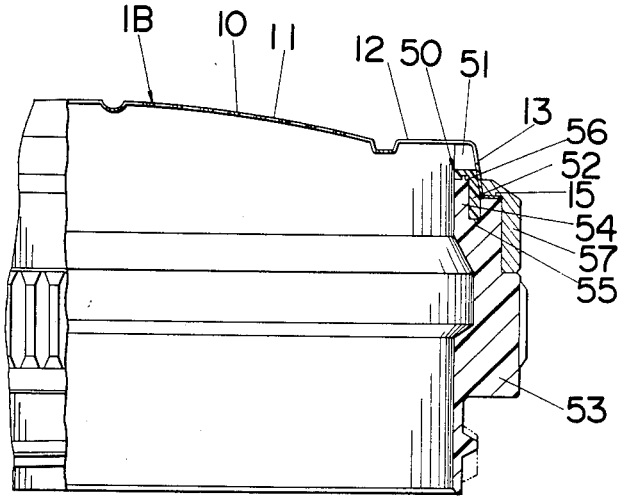
FIG. 6 is a cross section of an outer cutter assembly in accordance with a second embodiment of the present invention.

Referring to FIG. 6, there is shown an outer cutter assembly 1B in accordance with a second embodiment of the present invention which includes an outer shearing foil 10 of the same configuration as the above first embodiment. A comb forming member 50 is entirely positioned within the confines of a depending sidewall 13 and is integrally molded with a base frame 53. The base frame 53 is formed at upper end with an annular projection 54 which extends along the inner extremity of the base frame 53 to define outside thereof an annular groove 55 into which the lower portion 52 of the comb forming member 50 extends. The comb forming member 50 defines at its upper portion above the projection 54 a comb 51 having teeth in alignment with the webs separating the peripheral slots 12 in the outer shearing foil 10. Formed on the upper end of the annular projection 54 of the base frame 53 is an annular rib 56 which projects into the bottom of the comb 51 so as to inhibit it from shrinking inwardly at its solidification, eliminating the inward displacement of the comb 51 to assure an intimate contacting relation of the comb 51 with the outer shearing foil 10. After integral molding of the base frame 53 and the comb forming member 50, a sleeve ring 57 is forced to fit over the flange 15 of the outer shearing foil 10 around the upper end portion of the base frame 53 and to be staked thereon.

Figure 7:
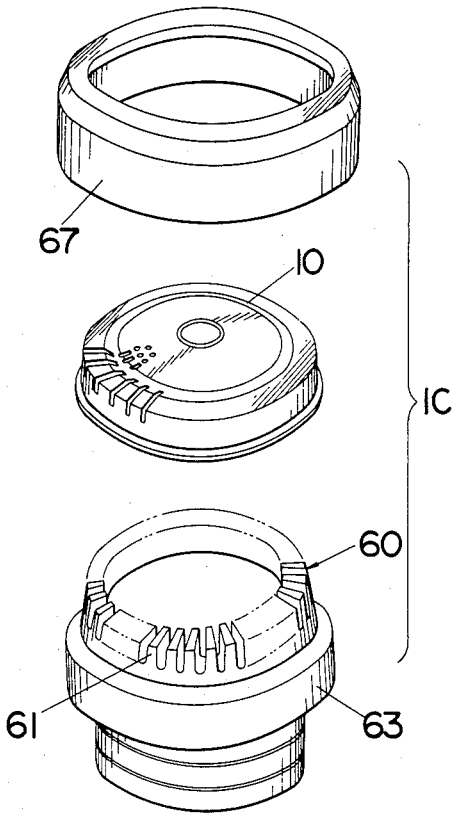
FIG. 7 is an exploded perspective view of an outer cutter assembly in accordance with a third embodiment of the present invention.
Figure 8A:
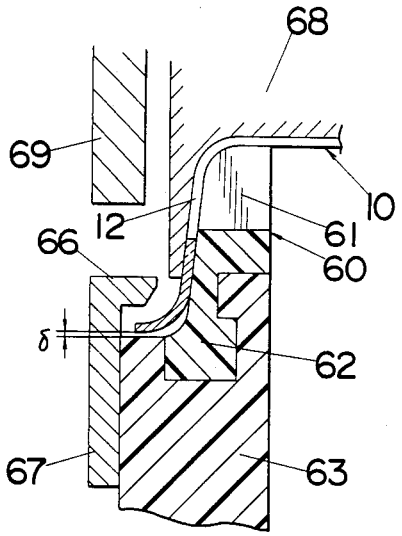
FIGS. 8A and 8B are respectively sectional views showing the operation of adhering a comb to an outer shearing foil while pressing a sleeve ring onto a base frame of the above outer cutter assembly.
Figure 8B:
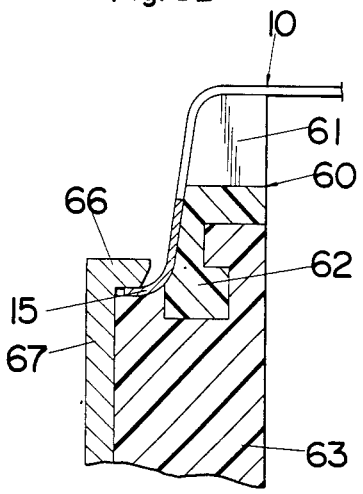
Figure 9:
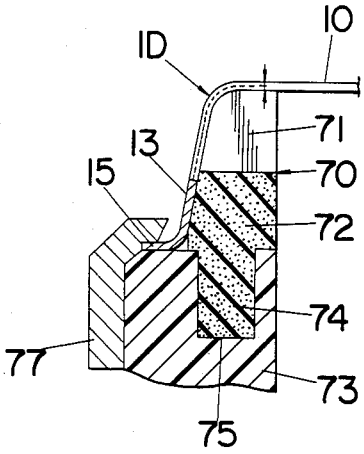
FIG. 9 is a sectional view of the peripheral portion of an outer cutter assembly in accordance with a fourth embodiment of the present invention.
Figure 10:
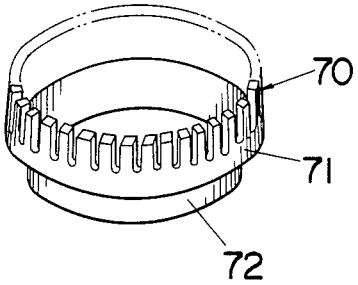
FIG. 10 is a perspective view of a comb forming member employed in the above outer cutter assembly.
Figure 11:
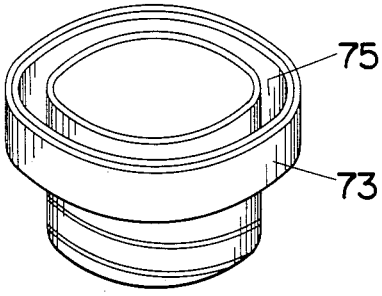
FIG. 11 is a perspective view of a base frame employed in the above outer cutter assembly.
Figure 12:
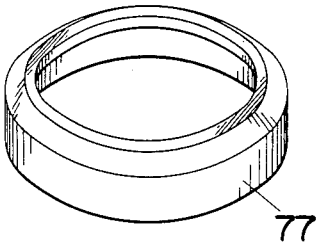
FIG. 12 is a perspective view of a sleeve ring employed in the above outer cutter assembly.

FIGS. 7 and 8 show an outer cutter assembly 1C in accordance with a third embodiment of the present invention. The outer cutter assembly 1C includes an outer shearing foil 10 of the same configuration as above, a base frame 63, a comb forming member 60, and a metal made sleeve ring 67. The comb forming member 60 defining at its upper portion a like comb 61 with teeth having their lower portion 62 projecting into the base frame 63 in an engaged manner for integral molding therewith. The outer shearing foil 10 is placed over the comb 61 integrally formed on the base frame 63 and is pressed thereagainst by means of a heater jig 68 while being heated thereby to melt a portion of the comb 61 in contact with the foil 10 in order to be heat welded to the comb 61, thus attaining an intimate contacting relation between the comb 61 and the outer shearing foil 10. To this end, the comb 61 is shaped to have an extra dimension $\delta$ by an amount of which the comb 61 is melted for providing intimate contact with the outer shearing foil 10. After the heat welding, the sleeve ring 67 is pressed down by a ring-shaped jig 69 to forcibly fit around the base frame 63 with the flange 15 of the outer shearing foil 10 held between an inturned rim 66 of the sleeve ring 67 and the base frame 63.

Referring to FIGS. 9 to 12, there is shown an outer cutter assembly 1D in accordance with a fourth embodiment which is similar in construction to the third embodiment except that a comb forming member 70 is made of elastic material which is pressedly received between an outer shearing foil 10 and a base frame 73. The comb forming member 70 defining at the upper portion a like comb 71 having teeth is formed on the bottom of the lower portion 72 thereof with a downwardly projecting annular skirt 74 which is forcibly inserted into an annular groove 75 in the upper face of the base frame 73 to be secured thereto. The comb 71 of the comb forming member 70 thus supported on the base frame 73 is pressed by the outer shearing foil 10 fastened to the base frame 73 by means of a like sleeve ring 77 to be compressed enough to assure an intimate contacting relation with an outer shearing foil 10. For this purpose, the comb 71 is shaped to have an initial dimension slightly greater than that of the assembled dimension by an amount Y compensating the amount of compression.

Figure 13:
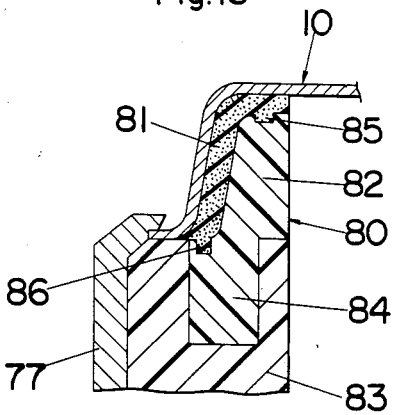
FIG. 13 is a sectional view of a modification of the embodiment of FIG. 10.

FIG. 13 shows a modification of the above fourth embodiment which is similar in construction to the embodiment except that a comb forming member 80 is molded by composite molding. The comb forming member 80 has its upper portion or comb 81 molded from elastic material while the other portion 82 thereof is made of a solid plastic material which is integrally molded with the base frame 83 with its downwardly projecting annular skirt 84 inserted in the upper end of the base frame 83. The comb 81 defines a contacting surface with the outer shearing foil 10 and is also molded integrally with the other portion 82 with hooks 85 and 86 on the line surface thereof inserted into the portion 82. In this modification, the comb 81 made of elastic material is likewise compressed by the outer shearing foil 10 to effectuate an intimate contacting relation with the outer shearing foil 10.

Figure 14:
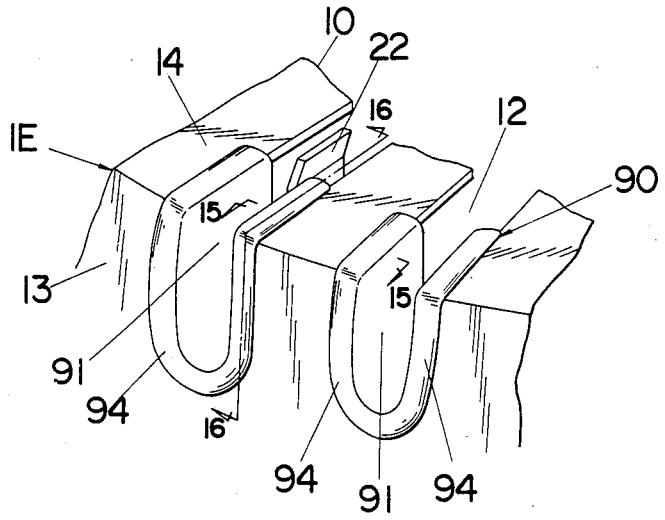
FIG. 14 is an enlarged perspective view of the peripheral portion of an outer cutter assembly in accordance with a fifth embodiment of the present invention.
Figure 15:
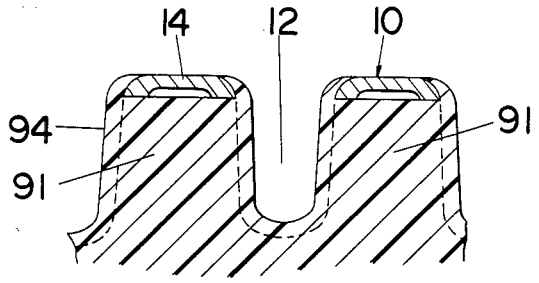
FIG. 15 is a cross section taken along line 15—15 of FIG. 14.
Figure 16:
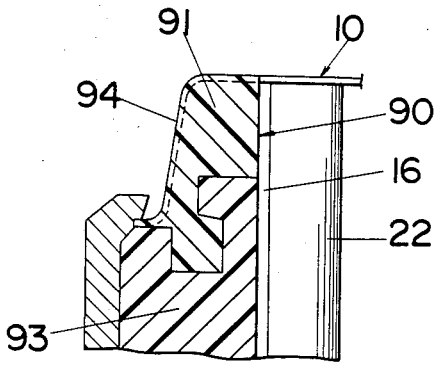
FIG. 16 is a cross section taken along line 16—16 of FIG. 14.

Referring to FIGS. 14 to 16, there is shown an outer cutter assembly 1E in accordance with a fifth embodiment of the present invention which is similar in construction to the second embodiment except that a comb 91 at the upper portion of a comb forming member 90 includes an extension or ear 94 along the edge on either side of each of the teeth thereof. The lower portion of the comb forming member 90 is integrally molded with a base frame 93. Each ear 94 projects outwardly of the outer shearing foil 10 to a slightest amount and lies along the edge of the adjacent slot 12 within the segment which does not come into shearing engagement with the inner blades 12 and extends to the bottom of the vertical opening in the depending sidewall 13 of the outer shearing foil 10 in such a way as to cover that segment of the edge in intimate contact therewith. At the bottom of each vertical opening the adjacent ears 94 are blended to be continuous with each other as best shown in FIG. 14. With the results of the above, not only the comb 91 is brought into intimate contact relation with the outer shearing foil 10 but also the portions of the edges of the peripheral slots 12 are intimately covered or hidden by the above ears 94, whereby hairs can be prevented from being trapped between the comb 91 and the outer shearing foil 10 as well as by the edges of the slots 12 during the operation of manipulating the cutting head across the skin of the user so as to assure a smooth shaving operation without irritating the skin of the user.

Figure 17:
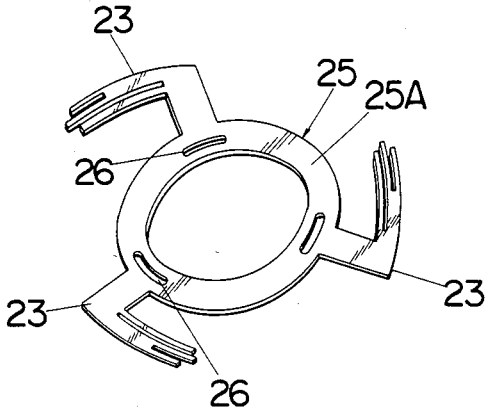
FIG. 17 is a perspective view of a spring employable in the inner cutter assembly for urging inner blades into hair shearing engagement with the outer shearing foil.
Figure 18A:
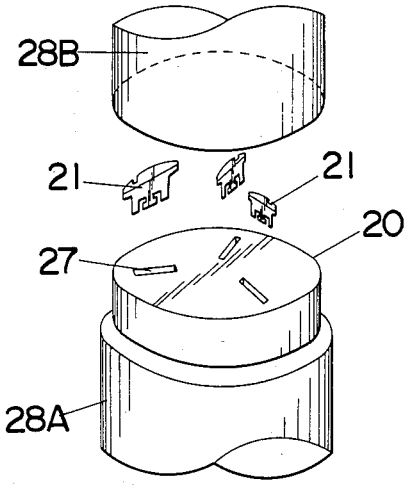
FIGS. 18A and 18B are respectively schematic illustrations of assembling the inner blades into the inner cutter assembly.
Figure 18B:
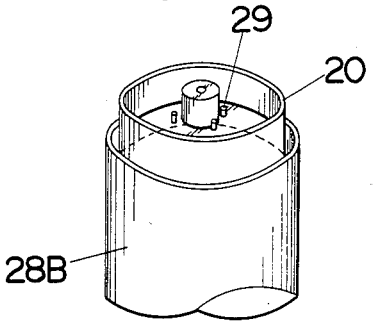
Figure 19A:
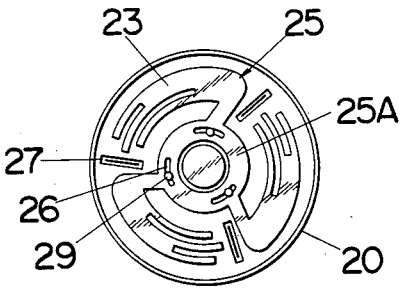
FIGS. 19A and 19B are bottom views illustrating the spring in the inner cutter assembly in its positions before and after connected to the inner blades.
Figure 19B:
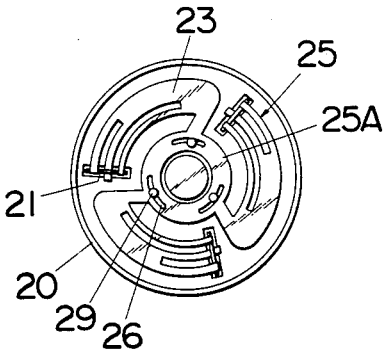

FIGS. 17 to 19 illustrate a procedure for mounting the inner blades 21 on the assembly base 20 of the inner cutter assembly 2 by the use of a spring 25, in which only the first inner blades 21 are shown for simplicity. The spring 25 comprises a ring 25A and three L-shaped spring leaves 23 extending radially outwardly therefrom and circumferentially spaced from one another at regular intervals. The ring 25A is formed in the portions from which the spring leaves 23 extend respectively with circumferentially elongated apertures 26. The free end of each spring leaf 23 is forked for engagement with the lower end of the inner blade 21. As shown in FIG. 18A, the inner blades 21 are firstly inserted in corresponding ports 27 in the assembly base 20 supported on a lower jig 28A, after which an upper jig 28B is placed over the assembly base 20 with the inner blades 21 held between the upper jig 28B and the assembly base 20. Then, the assembly base 20 is turned upside down with the inner blades 21 held on the upper jig 28B, as shown in FIG. 18B. In this position, the spring 25 is received in the bottom opening of the assembly base 20 in such a way that studs 29 on the bottom of the assembly base 20 extend into the respective apertures 26, as shown in FIG. 19A. The provision of said circumferentially elongated apertures 26 into which the studs 29 extends respectively allows the spring 25 to rotate about the center axis of the assembly base 20 while retained thereon until the forked end of each spring leaf 23 comes into engagement with the adjacent inner blade 21. Finally, the ends of the studs 29 are melted by the application of heat over the ring 25A so as to fix it in this position of connecting each spring leaf 23 to the adjacent inner blade 21. With this arrangement, the spring 25 can be easily connected to the inner blades 21, thus enabling easy assembling of the inner cutter assembly 2.

Although the present invention has been described in terms of specified embodiments adapted for use in a rotary type electric shaver, it should not be limited thereto an may be well adaptable for an reciprocatory electric shaver.

What is claimed is:

1. An outer cutter assembly for an electric shaver which comprises:

an outer shearing foil formed with a plurality of hair entrance peripheral perforations arranged along the periphery thereof to be in hair shearing relation with an inner blade sliding against the inner surface of the outer shearing foil;

a base frame on which the outer shearing foil is mounted with its peripheral edge supported thereby;

a comb forming plastic member provided between the peripheral edge of the outer shearing foil and the upper end of the base frame to have its lower portion connected to the base frame, said comb forming member being provided at its upper portion with a comb having teeth defining between the adjacent ones thereof slits each of which is in open communication with one of the peripheral perforations as well as located inside of the outer shearing foil, the teeth being in alignment with each of a plurality of webs separating adjacent ones of the peripheral perforations;

adjoining means for bringing each of the teeth in intimate contacting relation with each corresponding one of the webs to thereby prevent the presence of any gap therebetween;

said base frame being formed at its upper end with a projection which defines said adjoining means projecting into said comb forming member to separate the comb from the lower portion of the comb forming member in such a way that the upper portion undergoes shrinkage upon its solidification substantially independently of the shrinkage in the lower portion of the comb forming member, whereby the comb is subjected to a lesser amount of shrinkage so as to assure an intimate contacting relation between the teeth of the comb and the webs of the outer shearing foil.

2. An outer cutter assembly as set forth in claim 1, wherein said base frame is formed at its upper end with a rib which defines said adjoining means projecting into the comb at a position inwardly thereof in such a way as to prevent the inward displacement of the comb during its solidification.

3. An outer cutter assembly as set forth in claim 1, wherein said comb itself defines said adjoining means which is capable of adhereing the teeth of the comb respectively with the webs of the outer shearing foil in an intimate contacting relation therewith by being heated.

4. An outer cutter assembly as set forth in claim 1, wherein the teeth of said comb having at least a portion made of elastic material which defines said adjoining member to be pressed against the outer shearing foil for assuring an intimate contacting relation between the teeth of the comb and the webs of the outer shearing foil.

5. An outer cutter assembly as set forth in claim 1, wherein the teeth of said comb are provided along the edges on each side thereof with an ear which extends outwardly of the adjacent peripheral perforation in the outer shearing foil in such a way as to intimately cover the edge of that perforation at the portion which is not in shearing engagement with the inner blade.

* * * * *